US005267931A

United States Patent [19]

Faetini

[11] Patent Number: 5,267,931

[45] Date of Patent: Dec. 7, 1993

[54] CERVICAL ALIGNMENT AND ABDOMINAL EXERCISE DEVICE

[75] Inventor: James G. Faetini, 941 S. Braddock Ave., Pittsburgh, Pa. 15221

[73] Assignee: James G. Faetini, Pittsburgh, Pa.

[21] Appl. No.: 10,161

[22] Filed: Jan. 28, 1993

[51] Int. Cl.[5] ..... A63B 26/00

[52] U.S. Cl. ..... 482/140; 602/18; 128/DIG. 23

[58] Field of Search ..... 482/105, 126, 140, 95, 482/139, 907, 106, 124, 10; 602/18; 606/240; 128/DIG. 23

[56] References Cited

U.S. PATENT DOCUMENTS

| | | | |
|---|---|---|---|
| 1,884,392 | 10/1932 | Treat | 482/126 |
| 3,512,523 | 5/1970 | Barnett | 602/18 |
| 4,230,099 | 10/1980 | Richardson | 606/240 |
| 4,562,833 | 1/1986 | Pujals, Jr. | 602/18 |
| 4,863,158 | 9/1989 | Tassone | 482/140 |
| 4,905,993 | 3/1990 | Barone | 482/106 |
| 5,122,107 | 6/1992 | Gardner | 482/140 |
| 5,169,372 | 12/1992 | Tecco | 482/140 |

*Primary Examiner*—Richard J. Apley
*Assistant Examiner*—Jeanne M. Mollo

[57] ABSTRACT

A hand held contoured cervical alignment and abdominal exercise device that an individual cradles against the cervical spine when performing abdominal exercises. In use, it forces the individual to use the abdominal musculature correctly and prevents hyperflexion/hyperextension of the cervical spine and subsequent symptoms. The result is an increased efficiency in performing abdominal exercises while maintaining the bio-mechanical intergrity of the cervical spine.

3 Claims, 2 Drawing Sheets

CERVICAL ALIGNMENT AND ABDOMINAL EXERCISE DEVICE

BACKGROUND OF THE INVENTION

1. Field of the Invention

The present invention relates to a training device that insures proper and efficient abdominal exercise such as crunches and sit-ups while maintaining the integrity of the cervical spine biomechanics.

2. Prior Art

In exercising the abdominal musculature, doing sit-ups or crunches, there exist the problem of hyper-flexing the cervical spine, or neck. Commonly, the individual clasps the hands behind the head, then pulls forward for a sit-up or crunch. Doing so, the cervical spine is hyperflexed, thereby reversing the biomechanical function of the neck. Continued hyperflexion of the neck yields symptoms similar to a hyperflexion/hyperextension injury, commonly referred to as whiplash. However, the devices disclosed in the prior art do not provide the kind of portable cervical support needed when doing sit-ups or crunches, such as the "Self Actuated Cervical Traction Machine" for exercising the cervical area of Jones, U.S. Pat. No. 4,971,043 or "Cervical Traction Unit" which the user attaches to a door frame of Boren U.S. Pat. No. 4,869,240, or "Therapeutic Cooling Scarf, Wrap or Collar" of Swearingen U.S. Pat. No. 4,805,619.

No device is known, however, that prevents hyperflexion/hyperextension of the cervical spine while engaged in exercising the abdominal musculature.

SUMMARY OF THE INVENTION

It is therefore among the objects of the invention to provide for individuals who exercise, a simple device that greatly increases efficiency in performing abdominal exercises such as sit-ups or crunchs, while maintaining the biomechanical integrity of the cervical spine, which in use, prevents the whiplash effect.

It also is an object of the present invention to provide such a device which is of simple, inexpensive construction.

Another object is to provide such a device in lightweight form that is portable and can easily be transported to the exercise area.

And another object of the present invention is to provide such a device which is washable by ordinary means.

A further object is to provide such a device which, in use, will eliminate injury to the cervical spine while doing abdominal exercises such as sit-ups or crunchs, especially among inexperienced or beginning exercising individuals.

The foregoing objects can be accomplished by providing a hand-held device having a supporting member connected at each end to a hand grip. In the preferred embodiment of the invention, the supporting member is orthopedically contoured where it is intended to contact the cervical spine. In use, the supporting member is held by each hand grip against the cervical spine area, with the central orthopedically contoured portion of the supporting member cradling the cervical spine.

With these and other objects in view, the invention consists in the construction, arrangement, and combination of the various parts of the device, whereby the objects contemplated are attained, as hereinafter set forth, pointed out in the appended claims and illustrated in the accompanying drawing.

DETAILED DESCRIPTION

Figure 1:
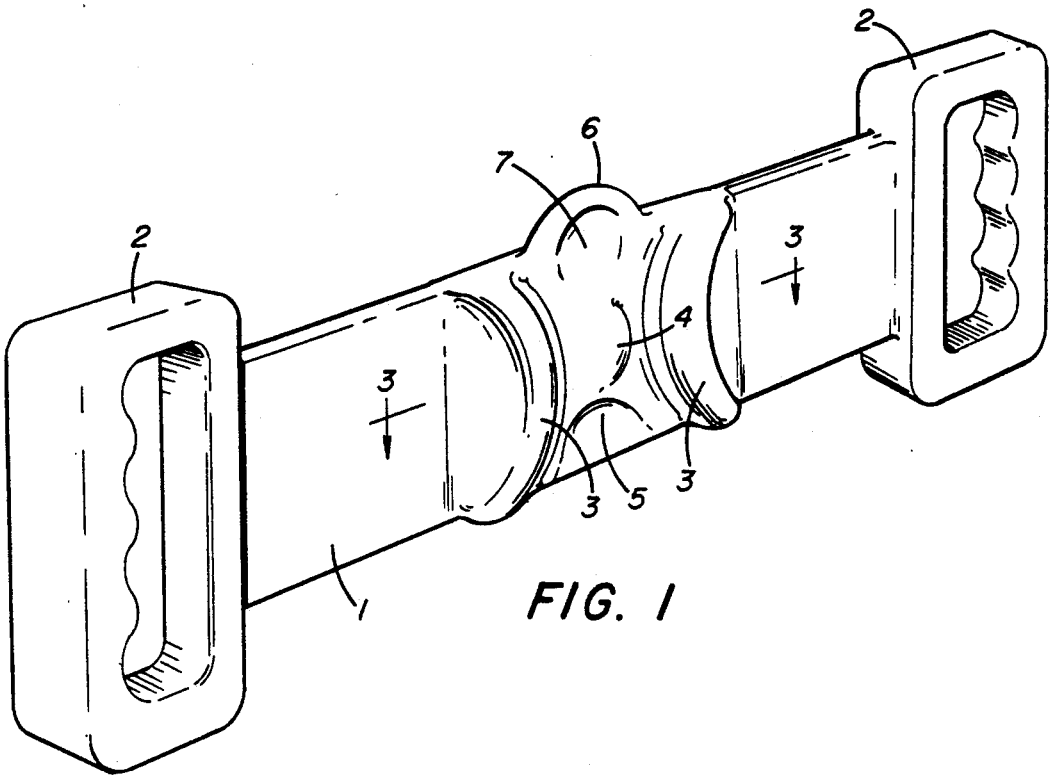
FIG. 1 is a full perspective view of a cervical alignment and abdominal exercise device in accordance with the present invention.
Figure 2:
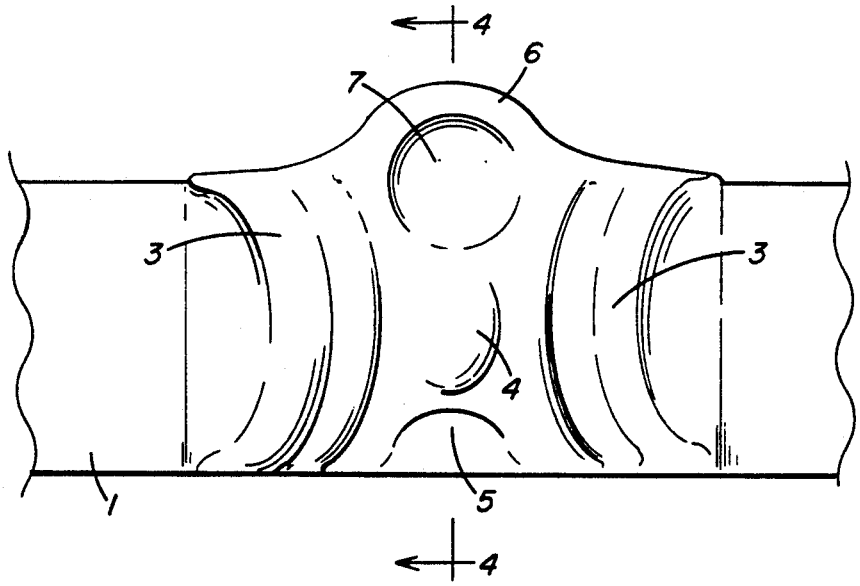
FIG. 2 is an enlarged, fragmentary front elevation of a central portion of such device with parts broken away.
Figure 3:
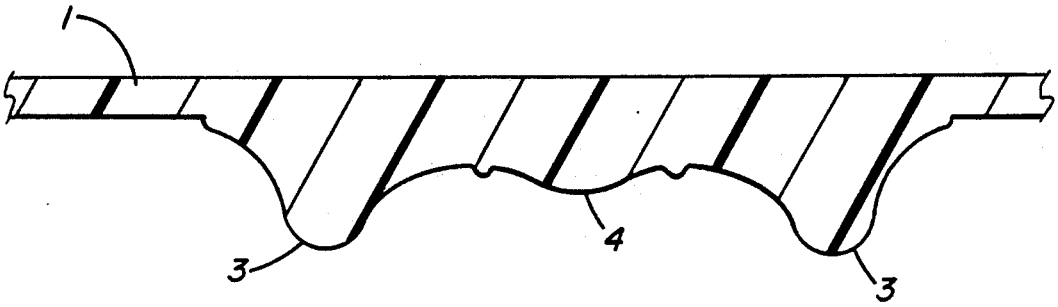
FIG. 3 is a horizontal cross-section view thru the central portion of this device.
Figure 4:
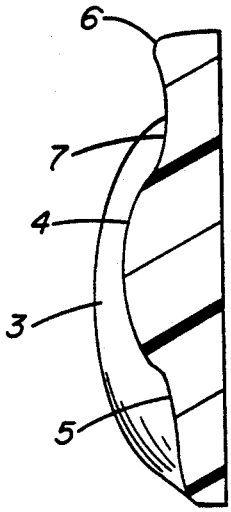
FIG. 4 is a vertical cross-section view thru the center portion of this device.
Figure 5:
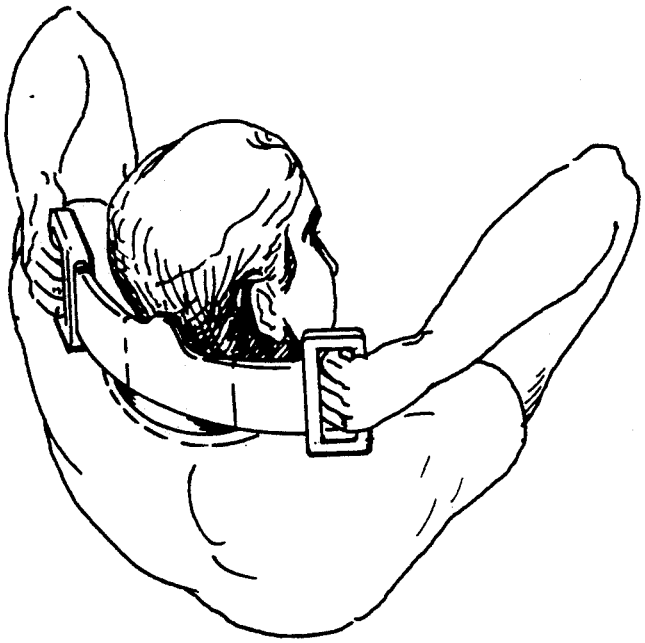
FIG. 5 is a perspective view of the device being demonstrated in accordance with the present invention.

Refer now to FIG. 1, which is an overall perspective drawing of a preferred embodiment of the invention. As shown in the drawing, a supporting member 1, including a backing, is connected at each end to a hand grip 2. The supporting member has a length spanning from each hand grip, a width with a top edge and a bottom edge, and a thickness. As best seen in FIG. 2, orthopedically contouredcervical support area is attached to a central portion of the supporting member and comprises bilateral longitudinal supports, an elevated surface, and inferior tapered area, and a tapered arch. The bilateral longitudinal supports 3 are angled medially and span the width of the supporting member as seen in FIG. 4 to fit into and support the laminal groove areas of the neck as in FIG. 5. Elevated surface 4, located centrally on the support are maintains a normal cervical curve at vertebrae four, five and six. Inferior tapered area 5, located on a bottom edge of the support are a accomodates transitional cervical vertebra seven and thoracic vertebra one A tapered arch 6, located on a top edge of the support and fits into the area between the occipital condyles, whereas the depressed area 7 cups the spinous process of the second cervical vertebra. The elevated area 4, the tapered area 5, and the tapered arch 6 are centrally located between the longitudinal supports 3.

Preferably, all components are molded in a one piece configuration in a strong, lightweight material that is flexible in a plane containing the backing of the support member.

In performing a situp or crunch exercise for example, the individual lies flat and grasps a hand grip 2 in each hand and places the face of the orthopedically contoured cervical support FIG. 2 against the back of the neck with the tapered arch 6 pointing upwards and fitting into the notch at the base of the occiput. This aligns the central elevated surface 5 and the longitudinal supports 3 with the mid-cervical lordotic curve and the laminal grooves respectively. The elbows are held at 180 degrees or directly lateral to the neck, assuring a snug fit of the orthopedically contoured cervical support area to the cervical spine, thereby maintaining the cervical curve and its normal biomechanical function while doing abdominal exercises such as situps or crunches.

Abdominal exercises can now be accomplished without hyperflexing the cervical spine, thus allowing the abdominal musculature to be exercised more efficiently by both inexperienced and experienced individual exercisers.

The construction of the device allows it to be maintained hygienically and easily transported in a pocket, gym bag or other similar conveyance.

Preferably, the length from handle end to end is at least 13 inches which puts the hands at a desirable width apart. The hand grips 2 are each 4.5 inches by 3.5 inches, whereas sling 1 is at least 2 inches wide by 7 inches. At the middle of the supporting member, preferably attached permanently is an orthopedically contoured cervical supporting area FIG. 2, which is sized to accomodate a child to an adult individual exerciser and is measured from inside to inside each bilateral longitudinal support 3, from 1 inch to 5 inches in width to at least 1 inch in height.

The many advantages in the use of this invention may be listed as follows:

(a) The lifting of the neck in doing abdominal exercises prevents stretching and weakening of the posterior longitudinal ligament, the interspinous ligament, and the ligamentum nuchae.

(b) Use of the device prevents stretching and weakening of the upper trapezious, splenius, rectus, levator scapula and erector spinal muscularture.

(c) Use of the device additionally prevents reversal or reduction of the lordotic cervical curve.

(d) And use of this device prevents posterior movement of the intervertabral disc and nucleus.

While the invention has herein been shown and described in what is conceived to be a practical and effective embodiment, it is recognized that departures may be made therefrom within the scope of the invention, which is not to be limited to the details disclosed herein but is to be accorded the full scope of the claims so as to embrace any and all equivalent devices.

Having described my invention, what I claim is:

1. A hand held cervical alignment and abdominal exercise device comprising:

a supporting member including a backing and defining a plane containing said backing, said supporting member having a width defining a top edge and a bottom edge and a length with a central portion and opposite ends, and being flexible in a plane perpendicular to the plane of the backing;

hand grips connected to the opposite ends of said supporting member;

and an orthopedically contoured cervical support and alignment pad, being made of a soft material and attached to the central portion of said supporting member, and adapted to conform to the back of the neck of a user, said pad including bilateral longitudinal supports angled medially and spanning the width of the supporting member adapted to fit into and support the laminal groove areas of the neck of the user, an elevated surface located centrally on said pad and adapted to maintain a normal cervical curve, an interior tapered area located on a bottom edge of the pad adapted to accommodate the user's transitional cervical vertebra seven and thoracic vertebra one, and a tapered arch located on a top edge of said pad adapted to support the area between the occipital condyles of the user, said elevated surface, said tapered area and said tapered arch are centrally located between said longitudinal supports.

2. A hand held cervical alignment and abdominal exercise device as in claim 1, wherein said supporting member comprises a relatively soft sheet material made of a synthetic plastic resin foam.

3. A hand held cervical alignment and abdominal exercise device as in claim 1, wherein said supporting member, said hand grips and said pad comprises a molded, one piece configuration.

* * * * *